US007471918B2

(12) United States Patent
Shishido et al.

(10) Patent No.: US 7,471,918 B2
(45) Date of Patent: Dec. 30, 2008

(54) IMAGE FORMING APPARATUS USING AN ELECTROPHOTOGRAPHIC PHOTOCONDUCTOR AND METHOD OF USING THE SAME

(75) Inventors: Makoto Shishido, Osaka (JP); Shiho Okawa, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 128 days.

(21) Appl. No.: 11/582,602

(22) Filed: Oct. 18, 2006

(65) Prior Publication Data

US 2007/0098442 A1 May 3, 2007

(30) Foreign Application Priority Data

Oct. 31, 2005 (JP) ..... 2005-316760

(51) Int. Cl.
*G03G 21/00* (2006.01)

(52) U.S. Cl. ..... 399/127; 399/98

(58) Field of Classification Search ..... 399/98, 399/127, 128, 174, 176
See application file for complete search history.

(56) References Cited

U.S. PATENT DOCUMENTS 6,516,169 B2 * 2/2003 Niimi et al. ..... 399/174 X
7,139,504 B2 * 11/2006 Yanagida et al. ..... 399/176 X

FOREIGN PATENT DOCUMENTS

JP 4-60660 A 2/1992
JP 6-83249 A 3/1994

* cited by examiner

*Primary Examiner*—Sandra L Brase
(74) *Attorney, Agent, or Firm*—Carmody & Torrance LLP

(57) ABSTRACT

The present invention provides an image forming apparatus which can, by uniformly leveling the particles which are non-uniformly adhered to the surface of the photoconductor by using a leveling means having a predetermined shape, and can maintain the excellent image characteristics for a long period even when a contact charging method is adopted as a charging means and an image forming method which uses the image forming apparatus. In an image forming apparatus which sequentially arranges a charging means, a developing means, a transferring means and a charge eliminating means around an electrophotographic photoconductor, the charging means is constituted of a contact-type charging means, and a leveling means which levels particles on a surface of the electrophotographic photoconductor is arranged between the transferring means and the charge eliminating means.

8 Claims, 9 Drawing Sheets

PRIOR ART

PRIOR ART

IMAGE FORMING APPARATUS USING AN ELECTROPHOTOGRAPHIC PHOTOCONDUCTOR AND METHOD OF USING THE SAME

BACKGROUND OF THE INVENTION

1. Field of the Invention

The present invention relates to an image forming apparatus using an electrophotographic photoconductor and an image forming method using such an image forming apparatus, and more particularly to an image forming apparatus which can maintain the excellent image characteristics by leveling particles using a predetermined leveling means when the particles remain on a surface of the electrophotographic photoconductor, and an image forming method which uses the image forming apparatus.

2. Related Art

Conventionally, an image forming apparatus which is used in a printer, a copying machine or the like adopts an image forming process which is configured by sequentially arranging, around an electrophotographic photoconductor, a charging means which charges the electrophotographic photoconductor, an exposing means which form a latent image by exposing a surface of the charged photoconductor, a developing means which develops the latent image by transferring a toner to the latent image, a transferring means which transfers the toner to a recording paper thus visualizing an image, and a charge eliminating means which erases a residual potential which remains on the surface of the photoconductor after transferring the toner.

Here, as the charging means, there have been known a contact charging method which brings a charging member such as a charging roller or the like into direct contact with the surface of the electrophotographic photoconductor, and a non-contact charging method which corona-charges the surface of the photoconductor using a corona charger. Due to the simple overall constitution and no generation of harmful substances such as ozone, the non-contact charging method has been put into practice more frequently.

However, in this contact charging method, the surface of the electrophotographic photoconductor and the charging member are directly brought into contact with each other and hence, there has been observed a phenomenon that particles which constitute developer components remaining on the surface of the photoconductor after printing are adhered to the surface of the charging member thus generating charging irregularities. Such charging irregularities lower a charging potential of the surface of the electrophotographic photoconductor after passing the charging means thus becoming one of causes of the so-called transfer memory in which a potential having polarity opposite to the charged polarity remains on the surface of the photoconductor after the transferring of the toner.

Accordingly, to overcome such a drawback, as shown in FIG. 8, there has been proposed an image forming apparatus 100 which uses a contact-type charging means 102 as a charging means and also includes a cleaning means 111 for cleaning a charged surface of the charging means 102 so as to remove foreign substances which are adhered to the charged surface (see patent document 1, for example).

Further, as shown in FIG. 9, there has been also proposed an image forming apparatus 200 which adopts an inversion developing method in which the image forming apparatus 200 includes a contact-type primary charging roller 202, a developing means 204, a transferring means 206 and a front exposure lamp 209, wherein the image forming apparatus 200 further includes a contact-type pre-charging roller 208 which is charged to the same polarity as the charging roller 202 upstream of the charging roller 202 (see patent document 2, for example). Due to such a constitution, a surface of a photoconductor which is charged with the polarity opposite to the polarity of the contact-type primary charging roller 202 is pulled up to the same polarity by the pre-charging roller 208 thus erasing the transfer memory.

[patent document 1] JP-4-60660 (claims, FIG. 1)

[patent document 2] JP-6-83249 (claims, FIG. 1)

SUMMARY OF THE INVENTION

[Problems to be Solved]

However, according to the image forming apparatus described in patent document 1, the charged surface of the charging means 102 and the cleaning means 111 are brought into direct contact with each other and hence, when the image forming apparatus is repeatedly used, the charged surface is worn out and hence, it is difficult to charge the charged surface uniformly whereby the generation of the charging irregularities is observed. It is difficult to completely eliminate the minute foreign substances from the charged surface and hence, slightly remaining foreign substances are accumulated on the charged surface whereby, when the image forming apparatus is used for a long period, the generation of charging irregularities is eventually observed also in this case.

Further, the image forming apparatus described in patent document 2 directly erases the generated transfer memory by applying a predetermined voltage to the surface of the photoconductor and hence, the image forming apparatus fails to sufficiently cope with the contamination of the charging means attributed to the adhesion of foreign substances which is one of causes which generate the transfer memory.

Accordingly, inventors of the present invention have made extensive studies to overcome the drawbacks and have completed the present invention based on finding that with the provision of an image forming apparatus which includes leveling means which uniformly levels the particles (or uniformly levels a thickness of a layer formed of the particles) on the surface of the electrophotographic photoconductor between the transferring means and the charge eliminating means, the particles which are adhered to the surface of the electrophotographic photoconductor can be leveled uniformly and hence, the charged state of the electrophotographic photoconductor is stabilized whereby the generation of the charging irregularities can be suppressed.

That is, it is an object of the present invention to provide an image forming apparatus which can, by uniformly leveling the particles which are non-uniformly adhered to the surface of the photoconductor by using a leveling means having a predetermined shape, suppress the charging irregularities and can maintain the excellent image characteristics for a long period even when a contact charging method is adopted as a charging means and an image forming method which uses the image forming apparatus.

[Means for Solving the Problems]

According to the present invention, there is provided an image forming apparatus which sequentially arranges a charging means, a developing means, a transferring means and a charge eliminating means around an electrophotographic photoconductor, wherein the charging means is constituted of a contact-type charging means, and a leveling means which levels particles on a surface of the electrophotographic photoconductor is arranged between the transferring means and the charge eliminating means. With such an image forming apparatus, it may be possible to overcome the above-mentioned drawbacks.

That is, according to the image forming apparatus of the present invention, the particles which are adhered to the surface of the electrophotographic photoconductor can be leveled using the predetermined leveling means and hence, the leveled particles are adhered to the surface of a charging member in a subsequent charging means whereby the generation of charging irregularities becomes small thus maintaining the excellent charging characteristic.

Further, in constituting the present invention, it is preferable that the leveling means may include a rotary portion which is brought into contact with the surface of the electrophotographic photoconductor, and the rotational direction of the rotary portion and the rotational direction of the electrophotographic photoconductor may be arranged orthogonal to each other.

Due to such a constitution, the rotational portion may be operated orthogonal to the moving direction of the particles which are adhered to the surface of the electrophotographic photoconductor and hence, it may be possible to make the adhered particles have a uniform thickness by effectively leveling the adhered particles while suppressing the wear of the surface of the photoconductor due to the contacting of the surface of the photoconductor with the rotary portion.

Further, in constituting the present invention, it is preferable that the rotary portion may include a drive roller which is arranged at a position close to the electrophotographic photoconductor, a support roller which is arranged parallel to the drive roller, an endless belt which is extended between and wrapped around the drive roller and the support roller, and a brush-like member which is arranged on a surface of the endless belt to be in contact with the electrophotographic photoconductor.

Due to such a constitution, it may be possible to bring the brush-like material into contact with the whole surface of electrophotographic photoconductor thus suppressing the charging irregularities in the axial direction on the surface of the electrophotographic photoconductor.

Further, in constituting the present invention, it is preferable that in the leveling means, a conductive layer may be formed on the surface of the endless belt and may be connected to a voltage applying a predetermined voltage to the electrophotographic photoconductor.

Due to such a constitution, it may be possible to apply the predetermined voltage to the surface of the photoconductor using the leveling means thus erasing a transfer memory which exists on the surface of the electrophotographic photoconductor.

That is, by imparting the function of a precharging means for erasing the transfer memory to the leveling means, the image forming apparatus can maintain the high-quality image characteristics.

Further, in constituting the present invention, it is preferable that the brush-like member may be a brush-like member having conductivity, and the yarn resistivity of the brush-like member may be set to a value equal to or less than $1\times10^{10}$ ($\Omega\cdot$cm).

Due to such a constitution, static electricity which is generated when the brush-like member is brought into contact with the surface of the electrophotographic photoconductor can be effectively eliminated, and when a voltage is applied to the leveling means, the brush-like member functions as a conductive line thus eliminating the transfer memory in a more efficient manner.

Further, in constituting the present invention, it is preferable that the leveling means may include a moving means for adjusting the position of the electrophotographic photoconductor.

Due to such a constitution, a contact state between the electrophotographic photoconductor and the brush-like member which is mounted on the leveling means, for example, a contact area, a pushing force or the like can be suitably changed thus realizing the leveling of the adhered particles in a more efficient manner.

Further, in constituting the present invention, it is preferable that the electrophotographic photoconductor may be a single-layered electrophotographic photoconductor.

Due to such a constitution, even when a contact charging method is adopted as the charging means, in charging the electrophotographic photoconductor, it may be possible to form a stable charging saturation region and hence, even when an initial charging potential is set low, it may be possible to stabilize the image characteristics.

Further, according to another aspect of the present invention, there is provided an image forming method which uses an image forming apparatus which sequentially arranges a charging means, a developing means, a transferring means and a charge eliminating means around the electrophotographic photoconductor, wherein the charging means is constituted of a contact type charging means, and the leveling means for leveling particles on a surface of the electrophotographic photoconductor is arranged between the transferring means and the charge eliminating means.

BRIEF DESCRIPTION OF THE DRAWINGS

FIG. 3A and FIG. 3B are schematic plan views showing the leveling means, wherein FIG. 3A is a plan view and FIG. 3B is a front elevational view;

BEST MODE FOR CARRYING OUT THE INVENTION

FIRST EMBODIMENT

Hereinafter, an image forming apparatus according to the first embodiment of the present invention is explained in conjunction with FIG. 1 to FIG. 7 by taking an image forming apparatus having the following constitution as an example.

That is, the image forming apparatus arranges a charging means, a developing means, a transferring means, and a charge eliminating means sequentially around an electrophotographic photoconductor, wherein the charging means is constituted of a contact-type charging means, and a leveling means which levels particles formed on the surface of the electrophotographic photoconductor is interposed between the transferring means and the charge eliminating means.

1. Basic Constitution

Figure 1:
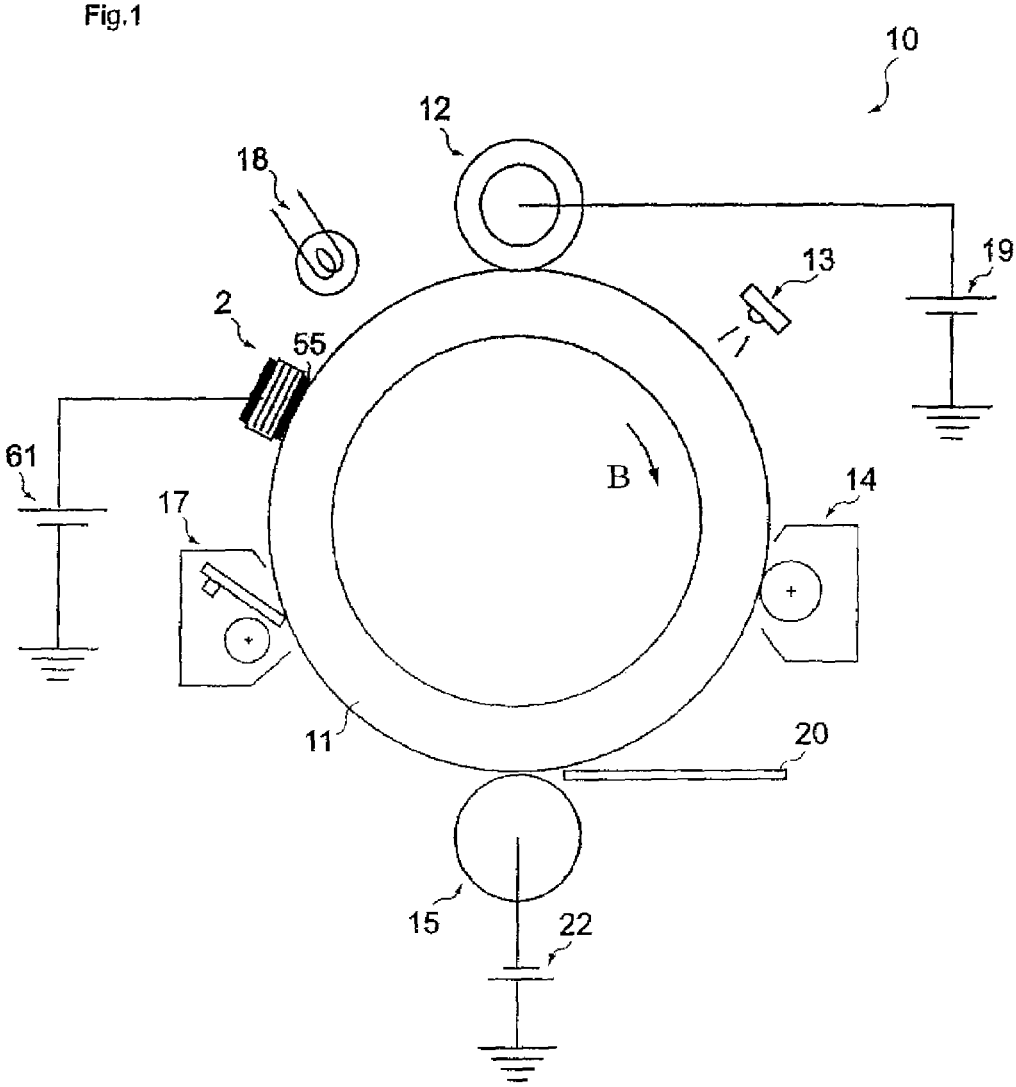
FIG. 1 is a schematic view of an image forming apparatus according to the present invention.

FIG. 1 shows the basic constitution of the image forming apparatus according to the present invention. The image forming apparatus 10 includes a drum-shaped single-layered electrophotographic photoconductor (also referred to as a photoconductor hereinafter) 11. Around the electrophotographic photoconductor 11, along the rotational direction shown by an arrow B, the image forming apparatus also sequentially arranges a charging means 12, an exposure means 13 which forms a latent image on a surface of the photoconductor, a developing means 14 which develops the latent image by adhering a toner to the surface of the photoconductor, a transferring means 15 which transfers the toner to a recording paper 20, a cleaning device 17 which removes the residual toner on the surface of the photoconductor, a leveling means 2 which levels particles which cannot be removed by the cleaning device 17 and remains on the surface of the electrophotographic photoconductor unevenly, and a charge eliminating means 18 which removes a residual potential on the surface of the photoconductor.

Further, a power source 19 for applying a charge-applying voltage is connected to the charging means 12.

The power source 19 can apply only a DC component or a superposed voltage which is obtained by superposing an AC component to the DC component. Here, by connecting the power source 19 to the charging means 12 such that a charging means 12 side assumes positive polarity, a positive-charge-type image forming apparatus can be formed.

On the other hand, a power source 22 is connected to the transferring means 15. The power source 22 is a power source which can apply a DC component and is connected to the transferring means 15 such that a transferring-means side assumes negative polarity. By adopting such a connection, a inverse-development-type image forming apparatus can be formed.

2. Leveling Means (1) Basic Constitution

The image forming apparatus of the present invention includes the leveling means 2 which levels the residual particles remaining unevenly on the surface of the electrophotographic photoconductor. The leveling means 2 is, as shown in FIG. 1, brought into contact with the surface of the electrophotographic photoconductor 11, and the leveling means 2 has a function of uniformly leveling the particles which cannot be removed by the cleaning device 17 such as inorganic particles or the like which constitute an additive agent such as titanium oxide, on the surface of the electrophotographic photoconductor 11.

Figure 2:
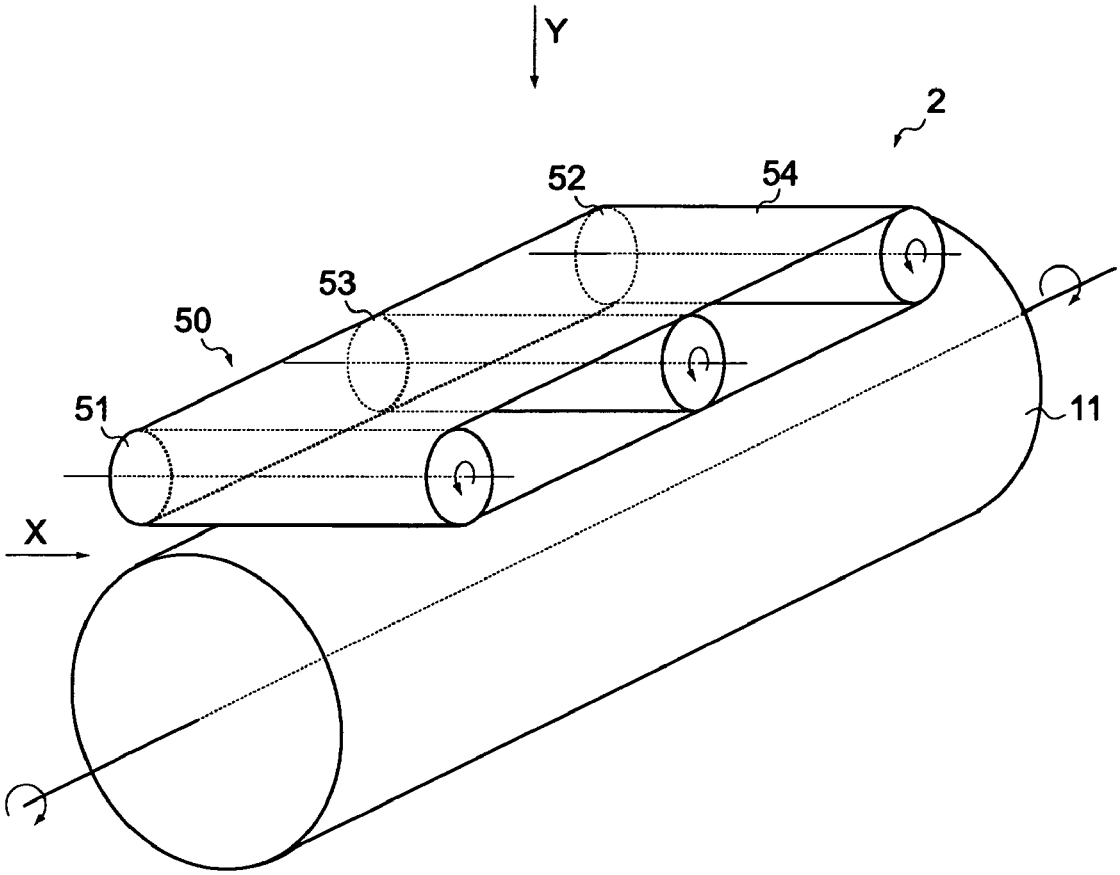
FIG. 2 is a schematic perspective view of a leveling means according to the present invention.
Figure 3:
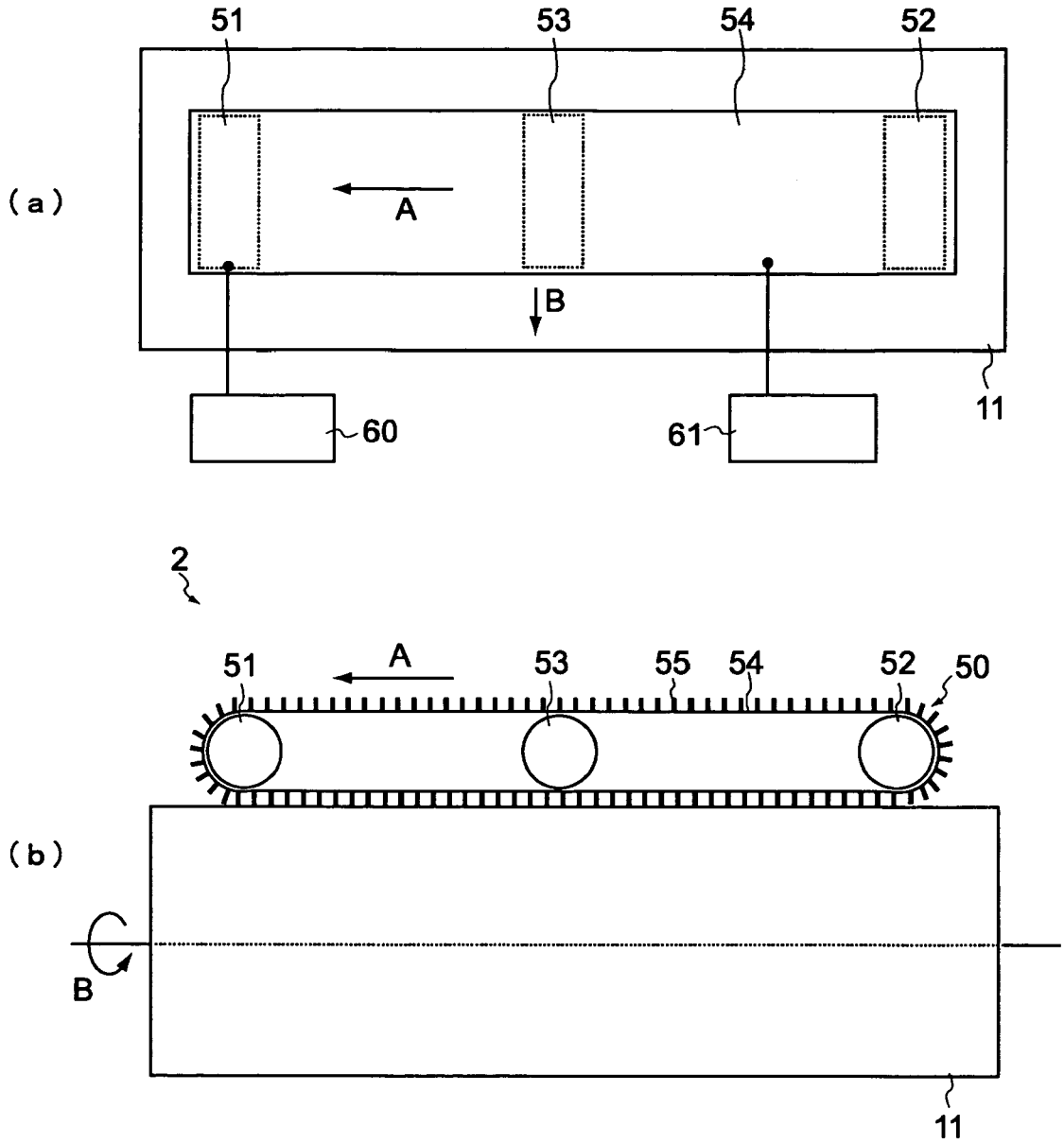

Here, FIG. 2, FIG. 3A and 3B show detailed drawings of the leveling means 2. FIG. 2 is a perspective schematic view of the leveling means 2 as viewed from an oblique direction, FIG. 3A and FIG. 3B are schematic plan views of the leveling means 2 in FIG. 2 as viewed from the direction indicated by an arrow Y and the direction indicated by an arrow X respectively.

The leveling means 2, as shown in FIG. 2 and FIG. 3A includes a rotational part 50 which is brought into contact with the surface of the electrophotographic photoconductor 11. It is preferable that the rotational direction A of the rotational part 50 and the rotational direction B of the electrophotographic photoconductor 11 intersect each other perpendicularly.

The reason is that by operating the leveling means perpendicular to the moving direction of the particles adhered to the surface of the electrophotographic photoconductor, it maybe possible to effectively level the adhered particles while suppressing a load applied to the surface of the electrophotographic photoconductor.

That is, for example, when the rotational part 50 is arranged such that the rotational direction A of the rotational part 50 and the rotational direction B agree to each other, chances that the adhered particles and the rotational part 50 are brought into contact with each other is decreased and a pressing force sufficient to make the adhered particles uniform cannot be obtained and hence, there may arise a possibility that the leveling means 2 cannot sufficiently achieve an original function thereof as a leveling means.

Accordingly, by adopting the positional relationship in which the rotational direction A and the rotational direction B intersect each other at right angles, the leveling means can effectively make the particles adhered to the surface of the electrophotographic photoconductor uniformly.

Here, it is not always necessary to continuously rotate the rotational part 50 in the fixed direction. For example, the rotational part 50 adopts a driving method in which the rotational direction is inverted at a fixed time interval, that is, the rotational direction A and the rotational direction -A are changed over alternately.

Further, the rotational part 50 in the leveling means 2, as shown in FIG. 3A and FIG. 3B, may be configured such that the rotational part 50 includes a driving roller 51 which is arranged at a position in the vicinity of the electrophotographic photoconductor 11, a support roller 52 which is arranged parallel to the driving roller 51, an endless belt 54 which is extended between and wound around the driving roller 51 and the support roller 52, and a brush-like member 55 which is mounted on the surface of the endless belt 54 such that the brush-like member 55 is brought into contact with the electrophotographic photoconductor 11.

Hereinafter, respective components are explained in detail.

(2) Driving Roller and Support Roller

As shown in FIG. 3A and FIG. 3B, the driving roller 51 is a cylindrical-shaped roller which is connected to a rotational power source 60 such as a motor and the driving roller 51 can be rotated at a predetermined rotational speed.

Further, the support roller 52 which is arranged parallel to the driving roller 51 is, similar to the driving roller, a cylindrical-shaped roller and a freely movable roller which is not connected to a power source.

That is, by using the driving roller 51 and the support roller 52, and extending an endless belt 54 between these rollers and winding the endless belt 54 around these rollers, it may be possible to rotate the endless belt 54 in the predetermined direction at a predetermined speed.

Further, when it is necessary to arrange the driving roller 51 and the support roller 52 spaced-apart from each other, that is, when the length of the photoconductor in the axial direction elongated, it is also preferable to provide a second support roller 53 at the center between the driving roller 51 and the support roller 52.

The reason is that with the provision of the second support roller 53, the deformation of the endless belt 54 due to its own weight thereof is prevented thus maintaining a contact condition of the endless belt 54 with the electrophotographic photoconductor 11 in a predetermined state.

(3) Endless Belt

Further, as shown in FIG. 3B, in the leveling means 2, the endless belt 54 may be arranged so that the endless belt 54 is extended between and is wound around the driving roller 51 and the support roller 52.

The endless belt 54 is preferably made of a resin material having stretching property such as rubber. The reason is, due to such a constitution, it may be possible to use the endless belt for a long period without causing plastic deformation while maintaining a contact pressure of the endless belt 54 applied to the surface of the electrophotographic photoconductor 11 at a fixed value.

Further, by imparting a function of a precharging means for erasing the transfer memory to the leveling means 2, it is preferable to form a conductive layer on a surface of the endless belt and to connect the conductive layer with a voltage applying means 61 for applying a predetermined voltage to the electrophotographic photoconductor, namely a photoconductor layer on the electrophotographic photoconductor.

The reason is that by providing such conductive layer and the voltage applying means, it may be possible to inject a predetermined current from the leveling means 2 to the surface of the electrophotographic photoconductor 11 thus applying the polarity opposite to the polarity of a surface potential remaining on the surface of the electrophotographic photoconductor 11 whereby the surface potential is erased.

Further, as a material for the conductive layer, polar rubber (ion conductive rubber) having semi-conductive property such as epichlorohydrin rubber, acrylonitrile-butadiene copolymer (NBR) or ion conductive rubber to which semi-conductive property is imparted by adding an ion conductive agent to urethane rubber, acrylic rubber, silicone rubber and the like may be used. Here, it is preferable to set the volume resistivity to a value which falls within a range from $1\times10^3$ to $1\times10^{10}$ (Ω·cm).

Further, as another aspect, the whole endless belt 54 may be constituted of such a conductive material.

Further, it is preferable that the leveling means 2 includes a moving means which can change a distance between the endless belt 54 and the surface of the electrophotographic photoconductor 11. The reason is that by using such a moving means, a pressing force between the brush-like member described later and the surface of the photoconductor can be adjusted and hence, a contact state between the brush-like member and the electrophotographic photoconductor is properly adjusted in response to an adhering condition of the particles.

Here, a pressing force of the brush-like member to the surface of the photoconductor may preferably set to a value which falls within a range from 0.1 to 100 (kgf/cm$^2$). By setting the pressing force to the value within such a range, it may be possible to effectively uniformly level the adhered particles without applying an excessive load to the driving of the photoconductor.

(4) Brush-like Member

Further, as shown in FIG. 3B, it is preferable that a brush-like member 55 is formed on a surface of the endless belt 54.

The reason is that with the use of a member which exhibits the relatively low contact resistance such as a brush-like member 55, it may be possible to uniformly level the particles adhered unevenly to the surface of the electrophotographic photoconductor without wearing the surface of the electrophotographic photoconductor. Further, with respect to such a brush-like member, by changing the bristle density or the like, a leveled state of the particles can be suitably adjusted thus effectively preventing the charging irregularities.

Here, the main function of the brush-like member 55 lies in uniformly leveling the particles which are unevenly adhered to the surface of the electrophotographic photoconductor rather than removing the particles from the surface of the electrophotographic photoconductor.

This is because that the complete elimination of the particles which cannot be eliminated even with the use of a cleaning device, for example, inorganic fine particles which are added from the outside using a physical eliminating method is difficult. In an attempt to forcibly remove such fine particles which are difficult to eliminate, the surface of the electrophotographic photoconductor may be damaged or is excessively worn out. However, as in the case of the present invention, by providing the means which mainly aims at the leveling of the particles rather than the elimination of the particles, in a contact-type charging means in a later stage, the particles are uniformly adhered to the surface of the charging means and hence, the generation of the charging irregularities can be suppressed.

Here, a material which is used for the brush-like member 55 is not particularly limited provided that the brush-like member 55 does not bring about the excessive wear to the surface of the electrophotographic photoconductor and can uniformly level the particles. For example, it is preferable to use a relatively soft fiber material such as polyamide resin or polyether. Further, as mentioned previously, when the function of the precharging means is imparted to the leveling means for eliminating the transfer memory, it is preferable that the brush-like member 55 is made of conductive fibers which is produced by adding conductive particles such as carbon into a fiber material.

The reason is that with the use of the brush-like member made of the conductive fibers, it maybe possible to efficiently eliminate the static electricity attributed to friction and, when a voltage is applied to the leveling means, the brush-like member functions as a conductive line thus enabling the more effective elimination of the transfer memory. Further, when the brush-like member is made conductive, by making the endless belt also conductive, the whole leveling means can be made conductive thus effectively erasing the transfer memory.

Further, in adopting the conductive brush-like member, it is preferable to set the yarn resistivity of the brush-like member to a value equal to $1\times10^{10}$ (Ω·cm) or less.

The reason is that when the value of the yarn resistivity of the brush-like member is excessively increased, it is necessary to apply a high voltage for erasing the transfer memory and hence, an abnormal discharge occurs in the vicinity of a contact portion between the brush-like member and the surface of the photoconductor thus giving rise to a possibility of lowering the image characteristic. Further, when the yarn resistivity of the brush-like member is excessively decreased to the contrary, a discharge phenomenon is hardly generated thus giving rise to a possibility of insufficient erasing of the transfer memory.

Accordingly, it is preferable to set the yarn resistivity to a value which falls within a range from $1\times10^3$ to $1\times10^{10}$ (Ω·cm), and more particularly to a value which falls within a range from $1\times10^5$ to $1\times10^9$ (Ω·cm).

(5) Charging Property

Subsequently, as an additional function of the leveling means 2, by forming the leveling means 2 using a conductive material, it may be possible to impart a function of a precharging means which deletes a transfer memory to the leveling means.

Such leveling means 2, as shown in FIG. 1, is constituted of a brush-like member 55 which is brought into direct contact with the electrophotographic photoconductor 11 and the voltage applying means 61 which applies a predetermined voltage to the brush-like member 55. Here, the voltage applying means 61 is connected such that the brush-like member 55 assumes a positive polarity side and a polarity opposite to the polarity applied to the transferring means 15 is applied to the voltage applying means 61.

Further, the voltage applying means 61 can, in conformity with a mode of the leveling means 2, also apply only a DC component. Still further, to obtain a stable charging property by expanding a charge saturation region, it may be possible to use a superposed voltage obtained by superposing an AC component to a DC component.

Further, in the leveling means 2, by applying a predetermined voltage to the brush-like member 55 using the voltage applying means 61, it may be possible to delete the transfer memory which is generated by the transferring means.

Here, as an applying condition which is applied to the leveling means 2, a current density ($I_b$) of a current which flows from the brush-like member 55 to the electrophotographic photoconductor 11 can be set to a value which is equal to or more than 700 ($\mu A/m^2$).

Figure 4:
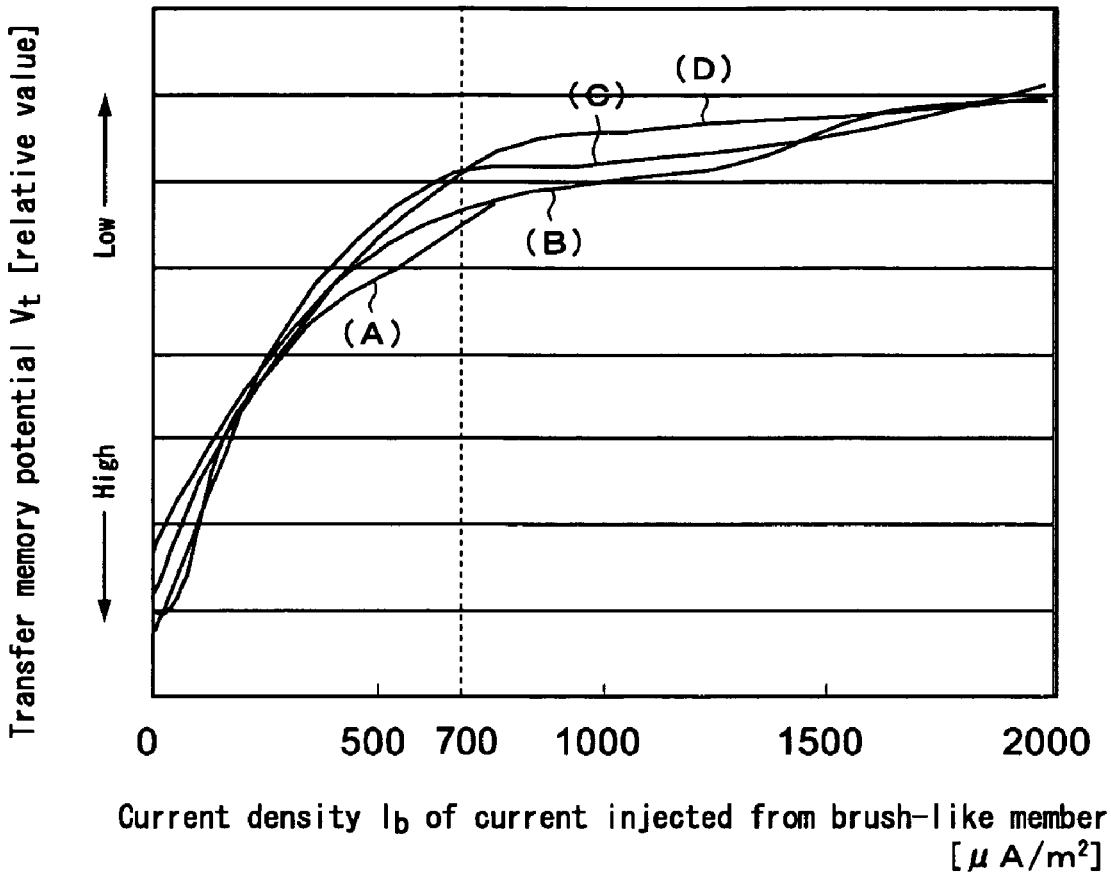
FIG. 4 is a characteristic graph showing the relationship between a current density ($I_b$) of a current which flows on a surface of a photoconductor from a brush-like member and a transfer memory potential ($V_t$)

Here, FIG. 4 is a characteristic view showing a relationship between the current density ($I_b$) of the current which is injected from the brush-like member and the transfer memory potential ($V_t$) in case a single-layered electrophotographic photoconductor for positive charging is used as the electrophotographic photoconductor.

In FIG. 4, the current density ($I_b$) of the current which is injected from the brush-like member is taken on an axis of abscissas and the transfer memory potential ($V_t$) is taken on an axis of ordinates.

That is, with respect to the axis of ordinates, the higher the transfer memory potential ($V_t$) is, the more effectively the transfer memory is erased by the leveling means, while the lower the transfer memory potential ($V_t$) is, the more insufficient erasing of the transfer memory by the leveling means becomes .

Further, curves (A) to (D) in FIG. 4 are characteristic curves when the conductive brush-like members which differ in yarn resistivity from each other are used. To be more specific, FIG. 4 expresses curves when the yarn resistivity is $1\times10^{12.5}$ ($\Omega\cdot$cm), $1\times10^{10.5}$ ($\Omega\cdot$cm), $1\times10^{8.5}$ ($\Omega\cdot$cm), $1\times10^{6.5}$ ($\Omega\cdot$cm) in order respectively.

Further, in the present invention, the transfer memory potential ($V_t$) is defined as a change quantity of a surface potential of the surface of the photoconductor at the developing position when the continuous printing is performed.

To be more specific, when white-paper image is printed by continuously rotating the photoconductor, assuming the surface potential of the surface of the photoconductor at the developing position in the first run as ($V_1$) and the surface potential of the surface of the photoconductor at the developing position in the third run as ($V_3$), the transfer memory potential ($V_t$) is defined as a value which is expressed by $(V_1)-(V_3)$.

As can be understood from FIG. 4, irrespective of the value of the yarn resistivity of the brush-like member, the higher the current density ($I_b$) is, the lower remaining transfer memory potential become. Particularly, it is safe to say that the transfer memory potential is erased stably when the current density ($I_b$) falls within a range equal to or more than 700 ($\mu A/m^2$).

To the contrary, when the current density ($I_b$) is excessively increased, an abnormal discharge occurs in the vicinity of a contact portion between the brush-like member and the surface of the photoconductor thus giving rise to a drawback with respect to the charging characteristics.

Accordingly, it is preferable to set the current density ($I_b$) to a value which falls within a range from 700 to 2000 ($\mu A/m^2$) and it is more preferable to set the current density ($I_b$) value which falls within a range from 1000 to 1500 ($\mu A/m^2$).

Further, in this embodiment, the current density implies a value which is obtained by dividing a current value by an applied area per second. That is, when the current having a current value I(A) flows in the photoconductor which has an axial length L(mm) and is rotated at a circumferential speed D(mm/sec), the current density can be expressed as I/(L×D) ($\mu A/m^2$).

Figure 5:
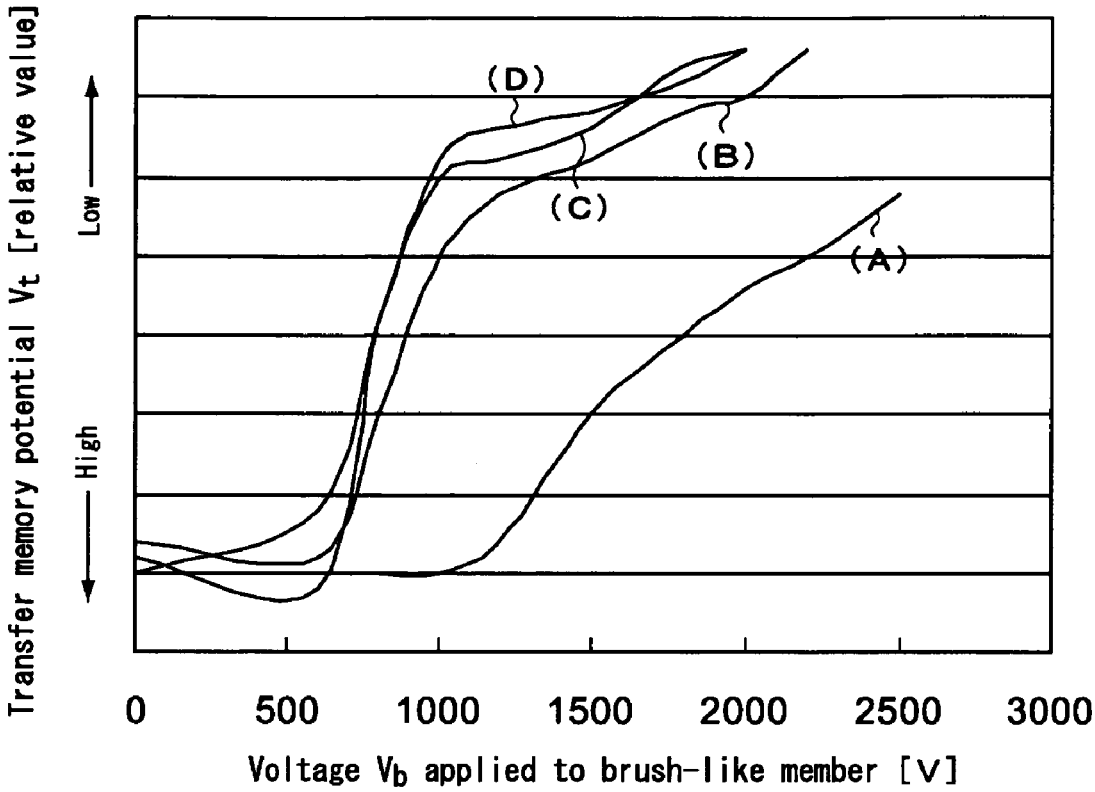
FIG. 5 is a characteristic graph showing the relationship between an applied voltage ($V_b$) which is applied to the brush-like member and the transfer memory potential ($V_t$)

Further, FIG. 5 is a characteristic graph which express the relationship between the applied voltage ($V_b$) to the brush-like member and the transfer memory potential ($V_t$).

In this characteristic graph, the applied voltage ($V_b$) to the brush-like member is taken along an axis of abscissas and the transfer memory potential ($V_t$) is taken along an axis of ordinates.

That is, FIG. 5 corresponds to a graph in which the current density ($I_b$) in FIG. 4 is converted into the voltage using the values of the respective yarn resistivities of the characteristic curves (A) to (D).

As can be understood from FIG. 5, the larger the value of the yarn resistivity of the brush-like member is, the higher the voltage needs to be applied to erase the transfer memory. Particularly, when the comparison of yarn resistivities is made under the same applied voltage, it is found that when the yarn resistivity of the brush-like member exceeds $1\times10^{11}$ ($\Omega\cdot$cm), the erasure of the transfer memory potential becomes remarkably insufficient.

That is, as described above, it is preferable to set the value of the yarn resistivity of the brush-like member to $1\times10^{10}$ ($\Omega\cdot$cm) or less.

Further, it is preferable to set the applied voltage ($V_b$) of the brush-like member to a value equal to or more than 1100 (V) in DC voltage. The reason is that, as shown in FIG. 5, it may be possible to lower the transfer memory potential ($V_t$) irrespective of an intrinsic resistance value of the brush-like member.

On the other hand, when the applied voltage ($V_b$) is excessively increased, an abnormal discharge is generated between the brush-like member and the photoconductor thus giving rise to a possibility that the charging characteristics are adversely influenced.

Accordingly, it is preferable to set the applied voltage ($V_b$) to a value which falls within a range from 1100 to 3000 (V), and it is more preferable to set the applied voltage ($V_b$) to a value which falls within a range from 1100 to 2000 (V).

Further, assuming the current density of the current which is injected from the brush-like member as $I_b$ ($\mu A/m^2$) and the current density of the current which is injected from the transferring means $I_t$ ($\mu A/m^2$), it is preferable to set a value which is expressed by $|I_b/I_t|$ to 2 or more.

Figure 6:
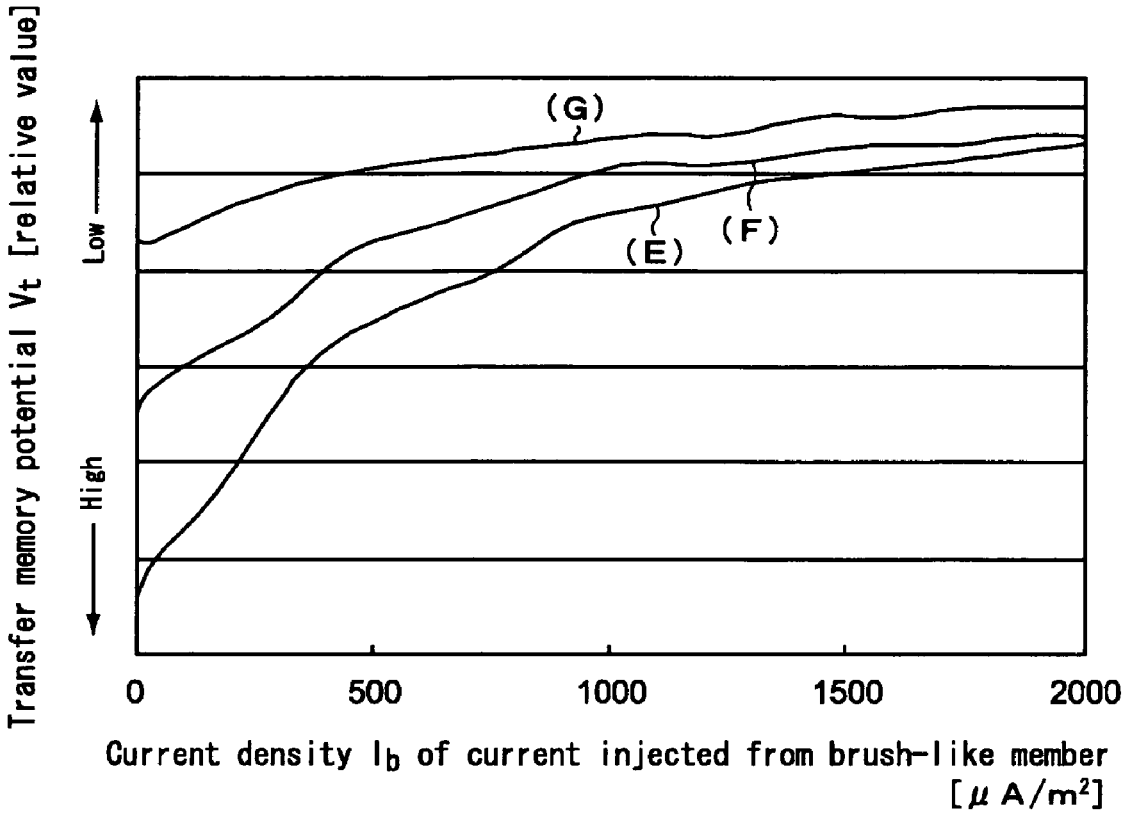
FIG. 6 is a characteristic graph showing the relationship between a current density ($I_t$) of a current which flows on a surface of a photoconductor from a transferring means and the transfer memory potential ($V_t$)

Here, FIG. 6 is a characteristic graph which expresses the relationship between the current density ($I_b$) of the current which is injected from the brush-like member and the transfer memory potential ($V_t$) when a brush-like member having a predetermined yarn resistivity is used as the brush-like member for every current density ($I_t$) of the current which is injected from the transferring means 15. Further, curves (E) to (G) in FIG. 6 are characteristic curves when the current density ($I_t$) of the current which is injected from the transferring means assumes −395 ($\mu A/m^2$), −316 ($\mu A/m^2$), −237 ($\mu A/m^2$) sequentially.

Figure 7:
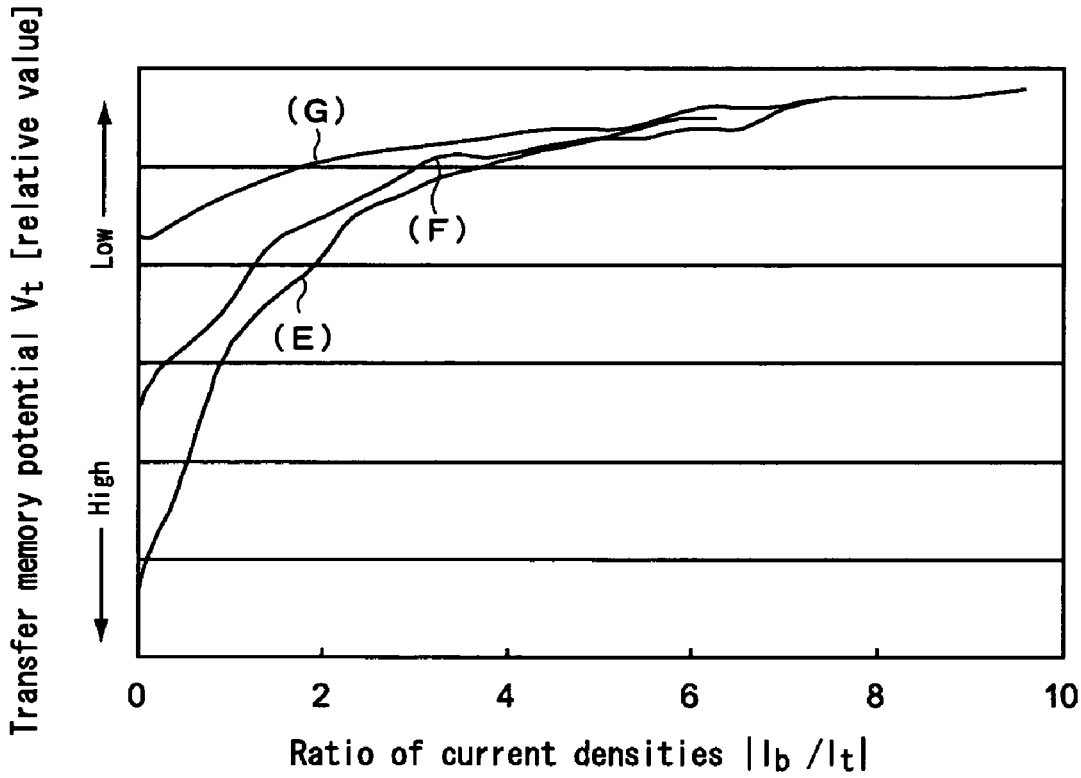
FIG. 7 is a characteristic graph showing the relationship between a ratio of current densities $|I_b/I_t|$ and the transfer memory potential ($V_t$)
Figure 8:
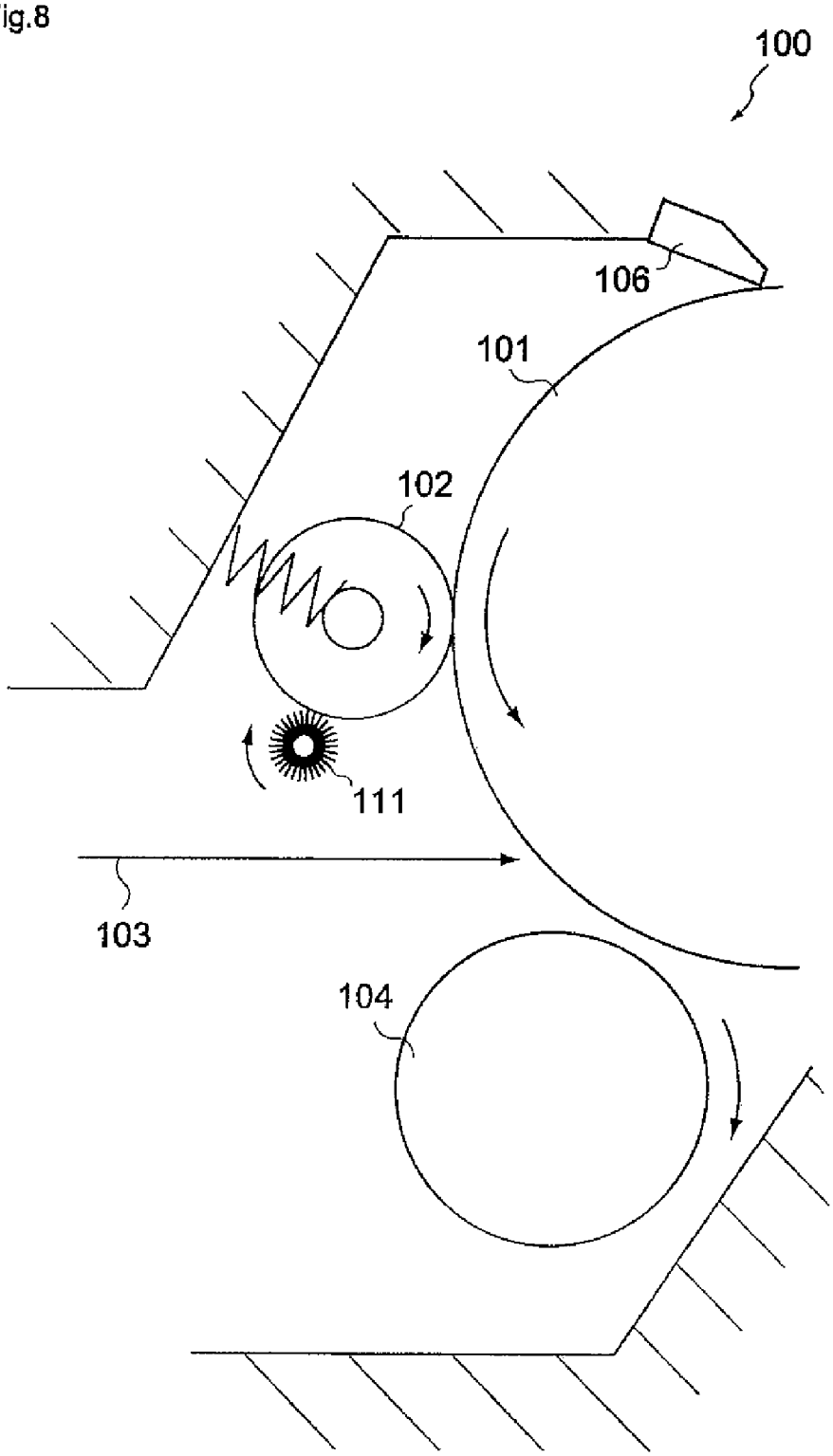
FIG. 8 is a view for explaining the constitution of a conventional image forming apparatus (No. 1)
Figure 9:
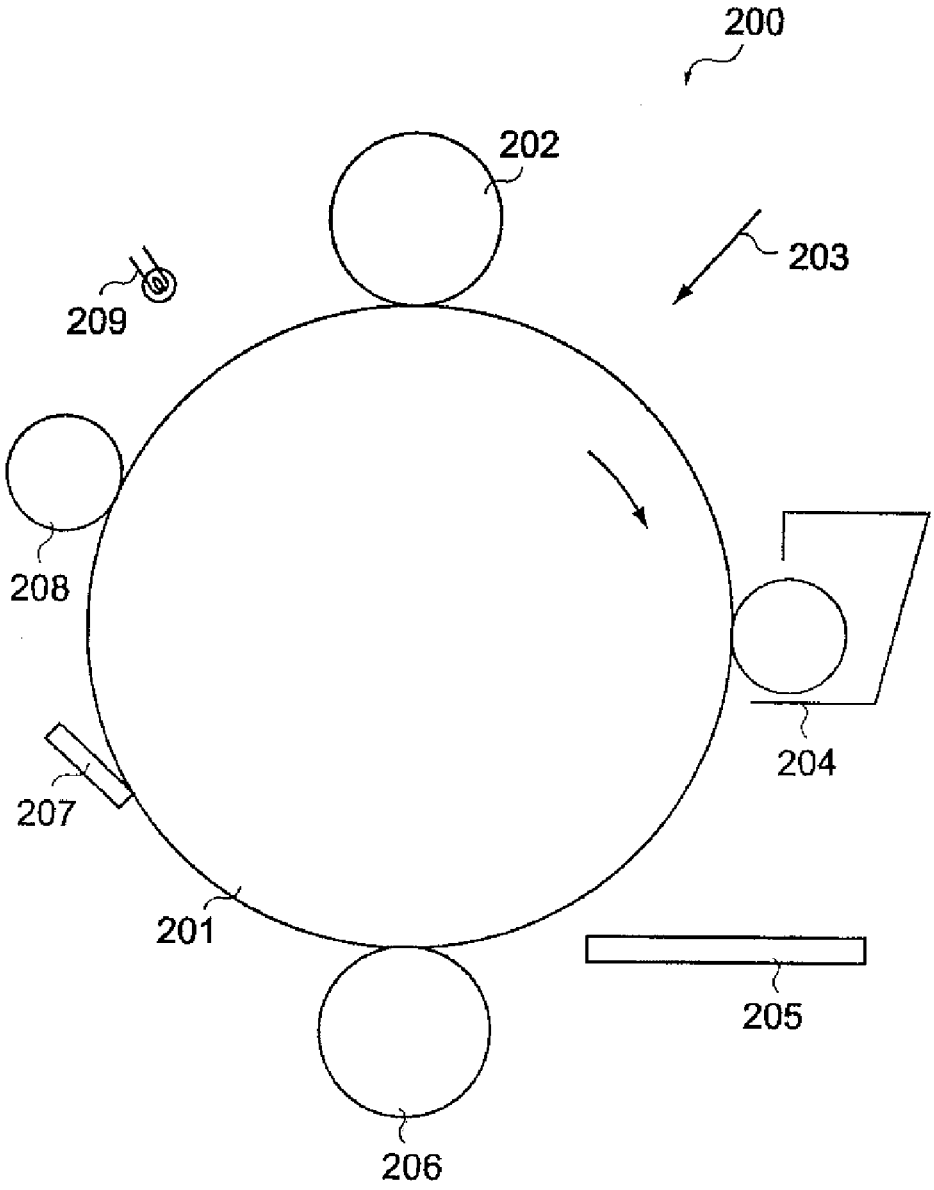
FIG. 9 is a view for explaining the constitution of a conventional image forming apparatus (No. 2)

Further, FIG. 7 is a characteristic graph in which the current density ($I_b$) of the current which is injected from the brush-like member is converted into a ratio of current density $|I_b/I_t|$.

As can be understood from these characteristic graphs, the larger an absolute value of the current density ($I_t$) of the current which is injected from the transferring means, the transfer memory potential ($V_t$) is increased. It is also understood from these characteristic graphs that when a value which is expressed by $|I_b/I_t|$ is set to 2 or more, the transfer memory potential ($V_t$) is sufficiently lowered.

That is, with respect to the characteristic curve (E), when the absolute value of the current density ($I_b$) of the current which is injected from the brush-like member is 790 or more, the transfer memory potential ($V_t$) is lowered. It is also found that when the absolute value of $I_b$ is 632 or more with respect to the characteristic curve (F) or when the absolute value of $I_b$ is 474 or more with respect to the characteristic curve (G), the transfer memories are sufficiently erased.

To the contrary, when the current density ($I_b$) is excessively increased, an abnormal discharge occurs in the vicinity of a contact portion between the brush-like member and the surface of the photoconductor thus giving rise to a drawback with respect to the charging characteristics.

Accordingly, it is preferable to set the value expressed by the $|I_b/I_t|$ to a value which falls within a range from 2.5 to 8.0 and it is more preferable to set the value expressed by the $|I_b/I_t|$ to a value which falls within a range from 3.0 to 6.0.

(3) Charging Means

Further, the present invention is also characterized in that the charging means for charging the surface of the photoconductor to a predetermined potential is a contact-type charging means.

The contact-type charging means, compared to a charging means which adopts a non-contact charging method such as corona charging, is miniaturized, and exhibits the excellent environmental property since the contact-type charging means does not generate harmful substances such as ozone which is generated in corona charging.

However, the charging means is configured to be brought into direct contact with the surface of the electrophotographic photoconductor and hence, a developer component, for example, an adding agent such as titanium oxide which unevenly remains on the surface of the electrophotographic photoconductor after printing is unevenly adhered to the surface of the charging member thus giving rise to a possibility of generating charging irregularities.

Accordingly, in the present invention, by providing the leveling means which has the predetermined shape, even when the contact-type charging means is used as the charging means, at a pre-stage of the charging means, it may be possible to uniformly level the particles which remain unevenly thus suppressing the generation of charging irregularities.

Further, in using such a contact-type charging means, it is preferable to use a single-layered electrophotographic photoconductor as a kind of the electrophotographic photoconductor 11.

The reason is that the single-layered electrophotographic photoconductor possesses the simple constitution compared to a stacked-type electrophotographic photoconductor and hence, the productivity of the electrophotographic photoconductor can be enhanced.

Further, in the present invention, with the use of the contact-type charging means as the charging means, one of drawback attributed to the single-layered electrophotographic phosphor that a charging saturation region is narrowed which is generated when a superposed voltage is used as a charging applied voltage can be overcome thus realizing the stable charging of the surface of the electrophotographic photoconductor.

Further, it is preferable to set an initial charging potential of the single-layered electrophotographic photoconductor due to this charging means to a value equal to or more than 400 (V).

The reason is that by setting the initial charging potential to the predetermined value or more, it maybe possible to obtain the desired image concentration while suppressing the image irregularities.

Further, with respect to the charging means, it is preferable to use the conductive rubber or the conductive sponge as a material of the contact portion with the surface of the photoconductor.

To be more specific, it may be possible to use polarity rubber (ion conductive rubber) having semi-conductivity such as epichlorohydrin rubber, acrylonitrile butadiene rubber (NBR), ion conductive rubber which imparts semiconductivity to urethane rubber, acrylic rubber, silicone rubber or the like by adding an ion conductive agent. Here, it is preferable to set the volume intrinsic resistance of the conductive rubber or the conductive sponge to a value which falls within a range from $1\times10^3$ to $1\times10^{10}$ ($\Omega\cdot$cm).

SECOND EMBODIMENT

Another aspect of the present invention is directed to an image forming method using an image forming apparatus which sequentially arranges a charging means, a developing means, a transferring means and a charge eliminating means around an electrophotographic photoconductor, wherein the charging means is constituted of a contact-type charging means and, a leveling means which levels particles on a surface of the electrophotographic photoconductor is arranged between the transferring means and the charge eliminating means.

Hereinafter, the further explanation of the contents which are already explained in conjunction with the first embodiment is omitted and the explanation is made by focusing on points which make the second embodiment different from the first embodiment.

That is, in carrying out the image forming method of the second embodiment, the image forming apparatus 10 shown in FIG. 1 may be preferably used.

Here, FIG. 1 is a schematic view showing the overall constitution of the image forming apparatus and the manner of operation of the image forming apparatus is sequentially explained.

First of all, the photoconductor 11 of the image forming apparatus 10 is rotated at a predetermined process speed (a peripheral speed) in the direction indicated by an arrow B and, thereafter, the surface of the photoconductor 11 is charged with a predetermined potential by the charging means 12.

Next, by using the exposure means 13, the surface of the photoconductor 11 is exposed with light which is modulated in response to the image information via a reflection mirror or the like. Due to this exposure, an electrostatic latent image is formed on the surface of the photoconductor 11.

Next, the latent image is developed by developing means 14 based on the electrostatic latent image. A toner is accommodated in the inside of the developing means 14, and a toner image is formed due to the adhesion of the toner to surface of the photoconductor 11 corresponding to the electrostatic latent image.

Further, a recording paper 20 is conveyed to a position below the photoconductor 11 along a predetermined transfer path. Here, by applying a predetermined transfer bias between the photoconductor 11 and the transferring means 15, the toner image is transferred to the recording paper 20.

Next, the recording paper 20 to which the toner image is transferred is separated from the surface of the photoconductor 11 by a separating means (not shown in the drawing) and is conveyed to a fixing unit by a conveyer belt. Next, after fixing the toner image to the surface of the recording paper 20 by heating and pressurizing using such a fixing unit, the recording paper 20 is discharged to the outside of the image forming apparatus 10 by discharge rollers.

On the other hand, after the transfer of the toner image, the photoconductor 11 is continuously rotated and the residual toner (adhering material) which is not transferred to the recording paper 20 is removed from the surface of the photoconductor 11 by the cleaning device 17 of the present invention.

Further, the particles which are not removed by the cleaning device 17, for example, the inorganic fine particles which constitute additives such as titanium oxide are leveled and are flattened by the leveling means 2.

Further, the charge which remains on the surface of the photoconductor 11 is completely erased by the radiation of the charge eliminating light from the electricity eliminator 18 and, thereafter, serves for the formation of the next image.

Accordingly, Due to the provision of the image forming apparatus of the present invention, even when the charging means adopts the contact-type charging method, by leveling the particles which are unevenly adhered to the surface of the photoconductor with the use of the leveling means having the predetermined shape, it may be possible to maintain the excellent image characteristics for a long period.

EXAMPLES

Example 1

1. Formation of Electrophotographic Photoconductor 2.7 parts by weight of X type non-metal phthalocyianine which forms a charge generating material, 50 parts by weight of stilbene amine compound which forms a hole transport agent, 35 parts by weight of azoquinon-based compound which forms an electron transport agent, 100 parts by weight of bisphenol Z type polycarbonate resin having an average molecular weight of 30,000 which forms a binding resin, and 700 parts by weight of tetrahydrofuran are filled in an agitation container and, thereafter, the contents of the container are mixed together and dispersed from each other using a ball mill for 50 hours thus producing a coating liquid. Next, the obtained coating liquid is applied to a conductive support body which is formed of an almite base tube using a dip coating method and, thereafter, the hot-air drying of 130° C. is performed for 45 minutes whereby a single-layered electrophotographic photoconductor having a film thickness of 30 μm and a diameter of 30 mm is obtained.

2. Formation of Brush-like Member and Endless Belt

A conductive nylon brush (single fiber fineness of 6.9 T, length of 5 mm, yarn resistance $1\times10^{8.5}$ (Ω·cm)) is used as the brush-like member.

Further, as the endless belt, an epichlorohydrin rubber which is an ion conductive rubber to which a conductive agent is added is used after forming the rubber into a shape having a width of 5 mm, a length (peripheral length) 500 mm, a thickness of 1 mm.

3. Adhesion Irregularity Evaluation in a Charging Roller

The obtained photoconductor is mounted on a printer KM-1500 remodel machine made by Kyocera Mita Corporation and, the brush-like member is brought into pressure contact with a surface of the photoconductor in a state that the brush-like member has a nip-width of 5 mm and a bristle biting quantity of 0.5 mm.

Next, the electrophotographic photoconductor is rotated at an outer-peripheral or circumferential speed of 110 (mm/sec) and, the brush-like member is rotated at a circumferential speed of 50 (mm/sec). Thereafter, a DC voltage of 1200 (V) is applied between the surface of the photoconductor and the charging means so as to charge the surface of the photoconductor with approximately 400 (V).

Finally, after applying a voltage of 2000 (V) to the brush-like member, 20000 sheets of recording papers are made to pass through the image forming apparatus for printing. Further, after printing, the adhesion irregularities on the charging roller are checked with naked eyes and, the generation of the concentration irregularities in gray images is checked. A leveling effect of adhered particles on the charging roller is evaluated based on following criteria. An obtained result of the evaluation is shown in Table 1.

G (Good): No adhesion irregularities are observed on the charging roller and no concentration irregularities are observed in the gray images.

F(Fair): Although the adhesion irregularities are observed on the charging roller, no concentration irregularities are found in the gray images.

B(Bad): Both of the adhesion irregularities on the charging roller and the concentration irregularities in the gray images are observed.

TABLE 1

| | belt circumferential speed (mm/sec) | voltage applied to brush $V_b$(V) | evaluation on adhesive irregularities |
|---|---|---|---|
| Example 1 | 50 | 2000 | G |
| Example 2 | 50 | 1900 | G |
| Example 3 | 50 | 1800 | G |
| Example 4 | 50 | 1700 | G |
| Example 5 | 50 | 1600 | G |
| Example 6 | 50 | 1500 | G |
| Example 7 | 50 | 1400 | G |
| Example 8 | 50 | 1300 | G |
| Example 9 | 50 | 1200 | G |
| Example 10 | 50 | 1100 | G |
| Example 11 | 50 | 0 | F |
| Comparison Example 1 | — | — | B |

Examples 2 to 11

In examples 2 to 11, the electrophotographic photoconductor and the brush-like member are prepared and evaluated under conditions substantially equal to the conditions of the example 1 except that the voltage applied to the brush-like member is changed. The obtained result is shown in Table 1.

Comparison Example 1

In comparison example 1, the electrophotographic photoconductor is prepared and evaluated under conditions substantially equal to the conditions of the example 1 except that the brush-like member is removed. The obtained result is shown in Table 1.

Example 12

The electrophotographic photoconductor, the brush-like member and the endless belt which are prepared in the same manner as the example 1 are mounted on a printer KM-1500 remodel machine made by Kyocera Mita Corporation and, the brush-like member is brought into pressure contact with the surface of the photoconductor in a state that the brush-like member has a nip-width of 5 mm and a bristle biting quantity of 0.5 mm.

Next, the electrophotographic photoconductor is rotated at a circumferential speed of 110 (mm/sec) and, the brush-like member is rotated at a circumferential speed of 50 (mm/sec). Thereafter, a DC voltage of 1200 (V) is applied between the surface of the photoconductor and the charging means so as to charge the surface of the photoconductor with approximately 400 (V).

Next, by applying a DC voltage between the transferring means and the surface of the photoconductor, the current density ($I_t$) of the current which is injected from the transferring means is set to −316 ($\mu A/m^2$)(−8($\mu A$) in a current conversion) and, thereafter, the transfer memory potential is measured and is evaluated based on following criteria. The obtained result is shown in Table 2.

G (Good): An absolute value of the transfer memory potential (V) is a value equal to or less than 8.

F(Fair): The absolute value of the transfer memory potential (V) is a value which exceeds 8 and equal to or below 12.

B (Bad): The absolute value of the transfer memory potential (V) is a value which exceeds 8.

Examples 13 to 21

In examples 13 to 21, the electrophotographic photoconductor and the brush-like member are prepared and evaluated under conditions substantially equal to the conditions of the example 12 except that the voltage applied to the brush-like member is changed. The obtained result is shown in Table 2.

TABLE 2

| | belt circumferential speed (mm/sec) | voltage applied to brush $V_b$ (V) | current density Ib ($\mu A/m^2$) | transfer memory potential $V_t$ (V) | evaluation on transfer memory |
|---|---|---|---|---|---|
| Example 12 | 50 | 2000 | 2367 | −3 | G |
| Example 13 | 50 | 1900 | 2216 | −4 | G |
| Example 14 | 50 | 1800 | 2064 | −6 | G |
| Example 15 | 50 | 1700 | 1894 | −6 | G |
| Example 16 | 50 | 1600 | 1723 | −7 | G |
| Example 17 | 50 | 1500 | 1553 | −7 | G |
| Example 18 | 50 | 1400 | 1383 | −8 | G |
| Example 19 | 50 | 1300 | 1212 | −9 | F |
| Example 20 | 50 | 1200 | 1023 | −9 | F |
| Example 21 | 50 | 1100 | 833 | −12 | F |

As can be understood from the results shown in Table 1 and Table 2, in the examples 1 to 21, with the use of the conditions which are adapted to the present invention, it may be possible to obtain the favorable results with respect to the charging characteristics and the evaluation of images.

On the other hand, in the comparison example 1, since the brush-like member is not used, the particles which remain unevenly on the surface of the electrophotographic photoconductor are kept continuously unevenly adhered to the surface of the charging means and hence, the defective result is observed in the evaluation of images.

INDUSTRIAL APPLICABILITY

According to the image forming apparatus and the image forming method using the image forming apparatus according to the present invention, by leveling the particles adhered to the surface of the electrophotographic photoconductor by using the predetermined leveling means, in the contact-type charging means, the particles which are uniformly distributed are adhered to the surface of the charging means, the generation of the charging irregularities is small thus allowing the image forming apparatus to maintain the excellent charging characteristics.

Accordingly, the image forming apparatus and the image forming method which uses the image forming apparatus of the present invention are expected to contribute to the acquisition of high-quality images and the miniaturization of the image forming apparatus.

The invention claimed is:

1. An image forming apparatus which sequentially arranges a charging means, a developing means, a transferring means, and a charge eliminating means around an electrophotographic photoconductor, wherein the charging means is constituted of a contact-type charging means, and a leveling means which levels particles on a surface of the electrophotographic photoconductor is arranged between the transferring means and the charge eliminating means.

2. The image forming apparatus according to claim 1, wherein the leveling means includes a rotary portion which is brought into contact with the surface of the electrophotographic photoconductor, and the rotational direction of the rotary portion and the rotational direction of the electrophotographic photoconductor are arranged orthogonal to each other.

3. The image forming apparatus according to claim 2, wherein the rotary portion includes a drive roller which is arranged at a position close to the electrophotographic photoconductor, a support roller which is arranged parallel to the drive roller, an endless belt which is extended between and wrapped around the drive roller and the support roller, and a brush-like member which is arranged on a surface of the endless belt to be in contact with the electrophotographic photoconductor.

4. The image forming apparatus according to claim 3, wherein in the leveling means, a conductive layer is formed on the surface of the endless belt and is connected to a voltage applying means for applying a predetermined voltage to the electrophotographic photoconductor.

5. The image forming apparatus according to claim 3, wherein the brush-like member is a brush-like member having conductivity and the yarn resistivity of the brush-like member may be set to a value equal to or less than $1\times10^{10}$ ($\Omega\cdot$cm).

6. The image forming apparatus according to claims 1, wherein the leveling means includes a moving means for adjusting the position with respect to the electrophotographic photoconductor.

7. The image forming apparatus according to claims 1, wherein the electrophotographic photoconductor is a single-layered electrophotographic photoconductor.

8. The image forming method which uses an image forming apparatus which sequentially arranges a charging means, a developing means, a transferring means and a charge eliminating means around the electrophotographic photoconductor, wherein The charging means is constituted of a contact type charging means, and a leveling means for leveling particles on a surface of the electrophotographic photoconductor is arranged between the transferring means and the charge eliminating means.

* * * * *